US008083565B1

(12) United States Patent
Fulton

(10) Patent No.: US 8,083,565 B1
(45) Date of Patent: Dec. 27, 2011

(54) ADJUSTABLE WEIGHTS FOR MODEL RACE CAR

(75) Inventor: C. Dwayne Fulton, Osage Beach, MO (US)

(73) Assignee: David L. Osment, Naples, FL (US)

( * ) Notice: Subject to any disclaimer, the term of this patent is extended or adjusted under 35 U.S.C. 154(b) by 120 days.

(21) Appl. No.: 12/571,901

(22) Filed: Oct. 1, 2009

(51) Int. Cl.
*A63H 27/32* (2006.01)
*A63H 27/00* (2006.01)

(52) U.S. Cl. ..... 446/68; 446/469

(58) Field of Classification Search ..... 446/61–68, 446/465–471, 236, 237, 46
See application file for complete search history.

(56) References Cited

U.S. PATENT DOCUMENTS 2,599,957 A * 6/1952 Walker ..... 446/68
3,839,818 A * 10/1974 Heggedal ..... 446/62
5,281,179 A * 1/1994 Wu ..... 446/68
5,383,805 A * 1/1995 Tsai ..... 446/66
6,774,294 B2 * 8/2004 Kugimoto et al. ..... 84/433
2007/0238390 A1 * 10/2007 Kelderhouse et al. ..... 446/469

* cited by examiner

*Primary Examiner* — Kien Nguyen
(74) *Attorney, Agent, or Firm* — Stinson Morrison Hecker LLP

(57) ABSTRACT

An adjustable weight system and method for adjusting the center of gravity and front and rear axle weights of a model race car. The adjustable weight system includes a cylinder having screw threads that are configured to form complemental threads in a surface surrounding a bore of an object that the cylinder is placed within. The cylinder is configured to engage a tool for adjustably positioning the cylinder within the bore and forming the complemental threads. The methods for adjusting the center of gravity and front and rear axle weights each include selecting a desired center of gravity location, front axle weight, or rear axle weight, placing at least a front or rear wheel of the car on a scale, and moving an adjustable weight on the car's chassis until the desired and actual center of gravity, front axle weight, or rear axle weight are approximately equal.

23 Claims, 2 Drawing Sheets

ADJUSTABLE WEIGHTS FOR MODEL RACE CAR

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to an adjustable weight system and method, and more particularly, to an adjustable weight system and method for adjusting the center of gravity and front and rear axle weights of a model race car.

2. Description of Related Art

The Pinewood Derby® is an annual competition for which children design and build model race cars. Each child is typically provided with a kit including a wooden block, four plastic wheels, and four small nails. The block is formed into the car's chassis and the nails are used as axles to affix the wheels to the car. The race track used for the derby consists of an inclined section which transitions into a horizontal section. The start line is at the top of the inclined section and the finish line is at the end of the horizontal track section.

Each group that sponsors a derby typically has a set of rules governing the competition. Conventionally, the rules limit the types of modifications that may be made to a car's chassis, wheels, and axles and the rules limit the maximum weight of a completed race car. While the maximum weight of a car is typically limited, a car builder is usually allowed to affix weights to the chassis or within cavities formed in the chassis. A car builder usually affixes weight to their car's chassis so that the car's weight equals or is slightly less than the maximum weight allowed by the governing rules. Often a car builder will affix weights to their car's chassis, test the performance of the car, move the weights to another position on the chassis, and repeat the testing. While this testing is preferable in order to determine the optimum position for the weights, it is difficult and cumbersome to continuously affix and remove the weights from the car.

BRIEF SUMMARY OF THE INVENTION

The present invention is an adjustable weight system that allows a model race car builder to quickly and easily vary the center of gravity and front and rear axle weights of their model race car. In accordance with one embodiment of the present invention, the adjustable weight system is for use with an object having a bore surrounded by a bore surface, and most preferably is for use within a bore formed in the chassis of a model race car. The system comprises a cylinder that is configured to be positioned within the bore. The cylinder has a side wall, opposing end walls joined with the side wall, screw threads that are integral with the side wall and configured to form complemental threads in the bore surface, and a structure associated with one of the end walls for engaging a tool for adjustably positioning the cylinder within the bore and forming the complemental threads.

Most preferably, the structure associated with one of the end walls comprises an opening configured to receive the end of a tool for rotating the cylinder within the bore. Preferably, a protrusion extends from the end wall that is opposite the end wall with the opening. The opening is configured to receive the protrusion so that multiple weights may be interlocked for quickly increasing or decreasing the weight of a model race car. Preferably, when two or more weights are interlocked, the mated protrusions and openings are configured so that the threads on each of the weights are aligned thereby ensuring they will engage the same complemental threads formed in the bore surface. Preferably, the protrusion comprises a spline that is configured to be received by a groove in the opening for ensuring that the threads on two interlocked weights are aligned.

The present invention also encompasses a method for adjusting the weight of an object using the cylinder described above. The method includes positioning at least a portion of the cylinder within a bore in an object so that the threads engage the inner surface surrounding the bore, and rotating the cylinder to move the cylinder to a desired position within the bore while the threads form complemental threads in the bore surface to retain the cylinder within the bore. According to the method, more than one cylinder may be interlocked as described above to vary the weight of the object.

According to another aspect of the present invention, the invention includes a method for adjusting the center of gravity of a model race car. This method includes the steps of selecting a desired center of gravity location for the race car; determining a distance between the desired center of gravity and the car's rear axle; weighing the race car; measuring the wheelbase, or the distance between the front and rear axles; placing the rear wheels on a stand; placing the front wheels on a scale to measure a front axle weight; calculating the distance between the car's center of gravity and the rear axle by multiplying the wheelbase by the measured front axle weight to get a first value and dividing the first value by the car's weight; and moving an adjustable weight on the chassis until the actual distance between the center of gravity and the rear axle is approximately equal to the desired distance between the center of gravity and the rear axle. Preferably, the adjustable weight used in this method is the cylinder described above.

The present invention also encompasses a method for adjusting the front and rear axle weights of a model race car. According to the method for adjusting the front axle weight, first, a desired front axle weight is selected for the car. Then, the rear wheels of the race car are placed on a stand, the front wheels are placed on a scale to measure the front axle weight, and an adjustable weight is moved on the chassis until the front axle weight equals the desired front axle weight. For adjusting the rear axle weight, the method is the same as described for the front axle weight except that the front wheels are placed on the stand, while the rear wheels are placed on the scale for measuring the rear axle weight. The adjustable weight used with either of these methods is preferably the cylinder described above.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
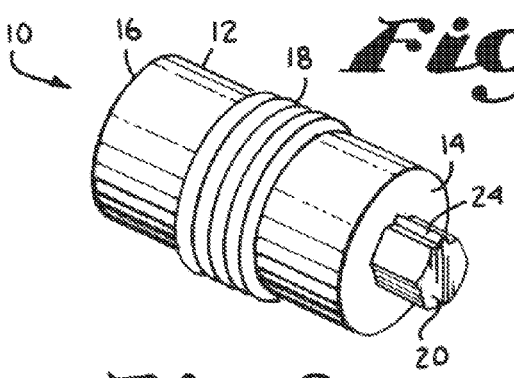
FIG. 1 is a perspective view of an adjustable weight according to the present invention.
Figure 2:
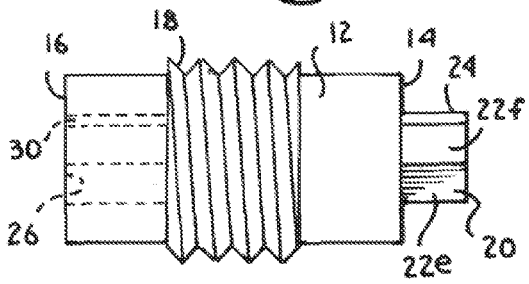
FIG. 2 is a side elevational view of the weight shown in FIG. 1.
Figure 3:
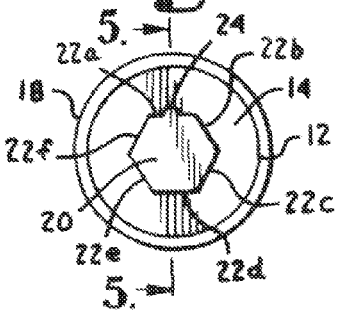
FIG. 3 is a front elevational view of the weight shown in FIG. 1.

A weight according to the preferred embodiment of the present invention is shown generally as 10 in FIG. 1. As shown in FIGS. 1-4, the weight 10 is a cylinder having a side wall 12 and opposing end walls 14 and 16 that are each joined with the side wall 12. The weight has male screw threads 18 that are integrally formed with the side wall 12. As shown in FIG. 3, the screw threads 18 have a major diameter that is slightly greater than the cross-sectional diameter of the side wall 12.

Figure 4:
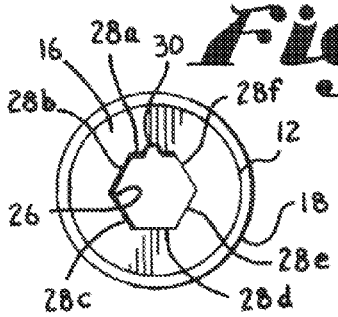
FIG. 4 is a rear elevational view of the weight shown in FIG. 1.
Figure 5:
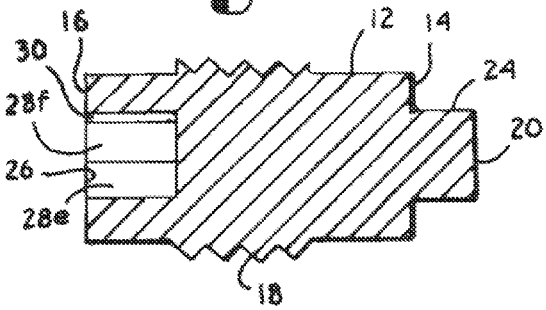
FIG. 5 is a cross-sectional view taken along the line 5-5 in FIG. 3.
Figure 6:
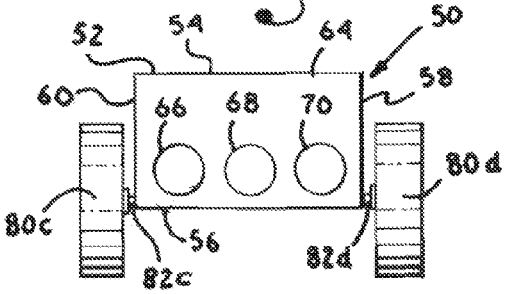
FIG. 6 is a rear elevational view of a model race car configured to receive the weight shown in FIG. 1.

Referring to FIG. 3, a hexagonal protrusion 20 having sides 22*a-f* is joined with and extends outward from end wall 14. A spline 24 is joined with and extends upward from side 22*a*. Referring to FIG. 4, end wall 16 presents a hexagonal opening 26 for accessing a recess within cylinder 12 that is surrounded by side walls 28*a-f*. There is a groove 30 in side wall 28*a*. Opening 26 and groove 30 are sized slightly larger than protrusion 20 and spline 24 such that the opening 26 and groove 30 can receive the protrusion 20 and spline 24 of another identical weight 10 for interlocking the weights as shown in FIG. 7.

Weight 10 is used to adjust the weight of any object having a bore within which the weight is inserted. While the weight may be used to adjust the weight of any object, the weight is preferably used for adjusting the weight of a wooden model race car, such as the race car 50 shown in FIGS. 6-9. By way of introduction, the model race car 50 has a chassis 52 having top and bottom surfaces 54 and 56, opposing side surfaces 58 and 60 and front and rear surfaces 62 and 64. There are three openings 66, 68, and 70 in the rear surface 64 for accessing cylindrical bores 72, 74, and 76 (FIG. 8) within the chassis 52. Preferably, the bores 72, 74, and 76 are formed in the chassis 52 with a drill press or hand held drill. The bores 72, 74, and 76 are configured for receiving weights such as weight 10 shown in FIGS. 1-5. Accordingly, each bore 72, 74, and 76 has a diameter that is slightly less than the major diameter of the screw threads 18 on weight 10. Cylindrical surfaces, one of which is shown as 78 in FIG. 7, surround each of bores 72, 74, and 76. As shown in FIG. 8, the car 50 has four wheels 80*a-d*, each of which are joined to the chassis 52 with an axle 82*a-d*. Each wheel 80*a-d* rotates about the respective axle 82*a-d* that joins the wheel to the chassis 52.

Figures 7, 8, 9:
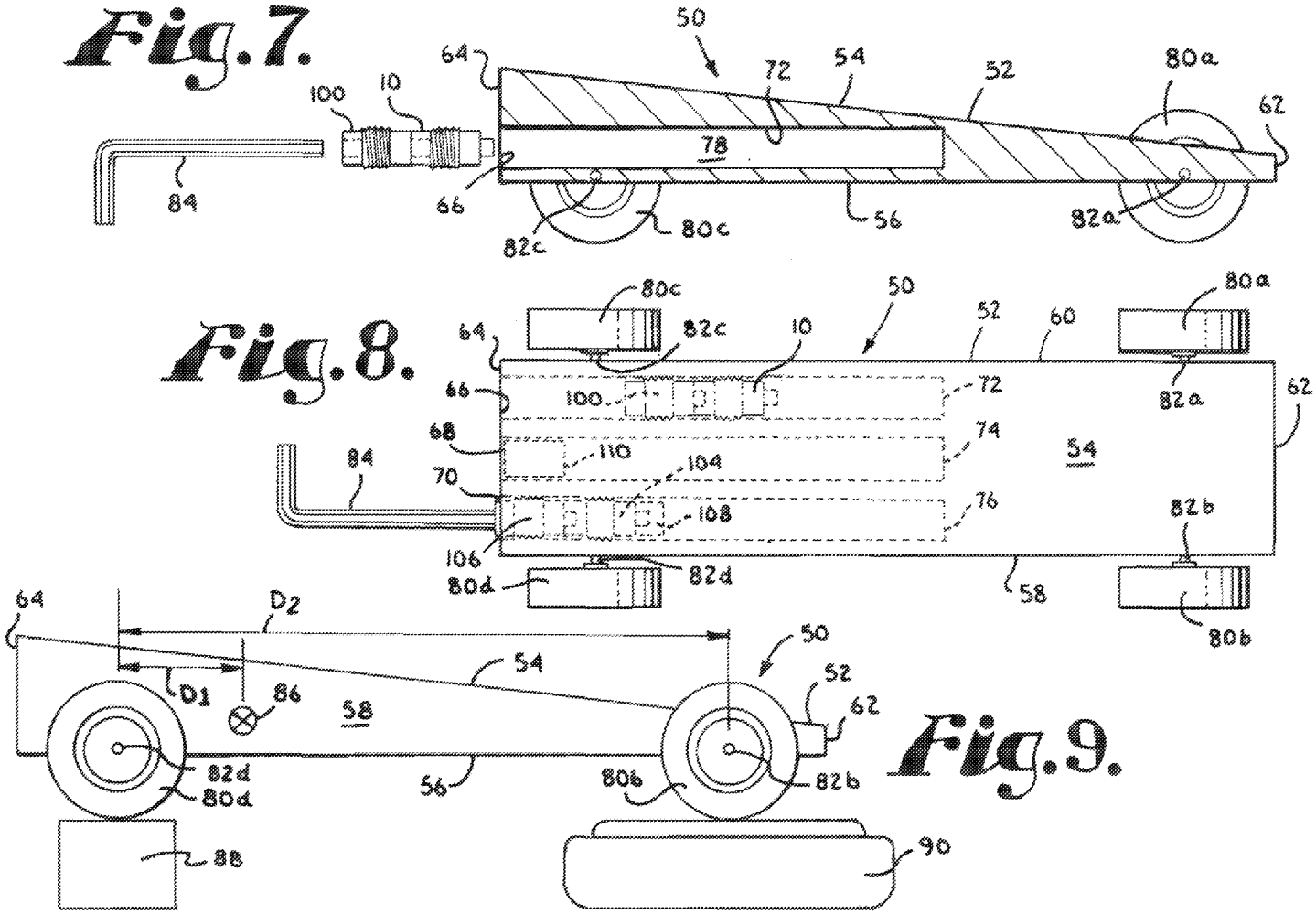
FIG. 7 is a cross-sectional side elevational view of the model race car of FIG. 6.
FIG. 8 is a top plan view of the model race car of FIG. 6 showing a plurality of adjustable weights positioned in bores of the race car.
FIG. 9 is a side elevational view of the model race car of FIG. 6 with a front wheel of the race car positioned on a scale and a rear wheel of the race car positioned on a stand.

Referring now to FIGS. 7 and 8, weight 10 is shown in operation as it is used to adjust the weight of the race car 50. FIG. 7 shows weight 10 before it is inserted through opening 66 and into bore 72, while FIG. 8 shows weight 10 positioned within bore 72. FIGS. 7 and 8 also show a weight 100 that is identical to weight 10 and that is interlocked with weight 10. The protrusion 20 and spline 24 extending from weight 100 are received by the opening 26 and groove 30 in weight 10 as described above. To position the weights 10 and 100 within bore 72, first, weight 10 is positioned within the bore 72 until the threads 18 begin to engage the surface 78 surrounding the bore. Then, the end of a hex key wrench 84 is inserted into the opening 26 in the rear surface of weight 100 for rotating the weights 10 and 100. Rotation of the weights 10 and 100 causes the threads 18 on weight 10 to form complemental threads in the inner surface 78 surrounding bore 72. Because the threads 18 on weights 10 and 100 are aligned by the spline 24 on weight 100 and the groove 30 on weight 10, the threads on weight 100 follow the threaded path created in surface 78 by the threads on weight 10. The alignment of the threads on interlocked weights 10 and 100 ensures that the threads on each of the weights follows the same path through the bore surface 78. The engagement between the threads 18 on weights 10 and 100 and the complemental threads formed in the surface 78 retains the weights 10 and 100 at a desired position within the bore 72. Thus, the threads 18 enable the weights 10 and 100 to be positioned at any desirable location within the bore 72 for adjusting the overall weight of the model race car 50 and the position of the car's center of gravity.

Figure 10:
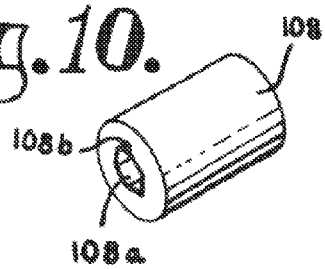
FIG. 10 is a perspective view of an alternative type of weight for linking with the weight shown in FIG. 1.

FIG. 8 also shows three additional weights 104, 106, and 108 which are positioned within bore 76 for adjusting the weight of race car 50. Weights 104 and 106 each have an identical structure to weight 10 shown in FIGS. 1-5, while weight 108 is a cylinder having a diameter that is substantially the same as cylinder 12 of weight 10. Weight 108, which is shown in more detail in FIG. 10, has an opening 108*a* with a groove 108*b* to receive the protrusion and spline on weight 104. Weight 108 does not have a protrusion extending from one of its end walls or threads formed into its side wall. Thus, weight 108 does not engage the threads formed within bore 76. While weights 10, 100, 104, and 106 preferably have a weight of approximately 0.5 ounces, weight 108 preferably weighs between approximately 0.0625 ounces to 0.5 ounces. Thus, weight 108 may be used for incrementally adding weight to model race car 50. FIG. 8 also shows a cylindrical weight 110 positioned within bore 74. Weight 110 is a solid cylinder that does not have the threads, opening, and protrusion of weight 10. The preferable use of weight 110 is described below with respect to a preferable method for adjusting the weight of the race car 50.

While weight 10 is shown interlocked with weight 100, it is within the scope of the invention for weight 10 to be used alone to modify the weight and center of gravity of race car 50, or for any number of weights to be interlocked for modifying the weight of the car. Further, although three bores 72, 74, and 76 are shown in the chassis 52 of race car 50, it is within the scope of the invention for there to be any number of bores in the chassis each for receiving any number of weights similar to weights 10, 100, 104, 106, 108, or 110.

While weight 10 preferably weighs approximately 0.5 ounces, it is within the scope of the invention for weight 10 to have any weight. Weight 10 is preferably made from tungsten; however, the weight may be made from any suitable material. While the preferred embodiment of weight 10 described above has a protrusion 20 and opening 26, it is within the scope of the present invention for the weight not to have a protrusion 20 and for the opening 26 to be any structure capable of engaging a tool for positioning the weight 10 within one of the bores 72, 74, and 76. For example, the end wall 16 may be configured to receive the end of any type of screwdriver, or the end wall 16 may be configured to be received by a socket for rotating the weight 10 within one of the bores. Further, while the protrusion 20 and opening 26 are hexagonal in the preferred embodiment described above, it is within the scope of the invention for the protrusion 20 and opening 26 to have any shape. Preferably, the protrusion 20 and opening 26 have complementary shapes so that multiple weights may be interlocked as shown in FIGS. 7 and 8. Most preferably, protrusion 20 and opening 26 are shaped such that when two weights are interlocked, the threads 18 on each of the weights are aligned. While preferably weight 10 has a spline 24 and groove 30 to ensure thread alignment on multiple interlocked weights 10, it is within the scope of the invention for the end walls 14 and 16 to have any structure that ensures thread alignment on interlocked weights.

The present invention also encompasses a method for adjusting the center of gravity of a model race car such as model race car 50 shown in FIGS. 6-9. It is important to adjust a model race car's center of gravity in order to increase the car's speed. Typically, model race cars are raced on a track which begins with an inclined section that gradually tapers down to a horizontal section. The inclined section of the track allows the model race cars to build speed before entering the horizontal section. The higher that a car's center of gravity is at the beginning of a race, the more potential energy that car will have for conversion into kinetic energy. Higher kinetic energy translates into increased speed and a reduced time that it takes for the car to complete the race. The farther rearward that a car's center of gravity is located, the higher it is when the car is placed on an inclined track. However, if a car's center of gravity is positioned too far toward the rear of the car, the car's front wheels will lift from the ground when the car transitions from the inclined section to the horizontal section of the track. This lifting causes the car to lose control, which in turn slows the car to a greater extent than the speed gain due to positioning the center of gravity further rearward. Thus, it is important to adjust the car's center of gravity to a position that maximizes the potential energy of the car while minimizing the loss of control and speed caused by lifting of the front wheels.

According to a preferred method for adjusting the center of gravity of model race car 50, first, a desired center of gravity location is selected for the model race car. While the desired center of gravity location may be selected by trial and error, typically it is preferably located between approximately 0.5 to 1 inch forward of the car's rear axles 82*c* and 82*d*. The actual center of gravity of race car 50 is shown as 86 in FIG. 9. Next, the distance between the rear axles 82*c* and 82*d* and the desired center of gravity is determined. As described above, preferably this distance is between approximately 0.5 to 1 inch. The distance between the actual center of gravity 86 and the rear axles 82*c* and 82*d* is shown as D1 in FIG. 9. The model race car 50 is then weighed and the weight, $W_{car}$, is recorded. The distance between the front axles 82*a* and 82*b* and the rear axles 82*c* and 82*d*, or the wheelbase, is then measured and recorded. This distance is shown as D2 in FIG. 9.

After determining these values, the rear wheels 80*c* and 80*d* of the race car are placed on a stand 88, as shown in FIG. 9, while the front wheels 80*a* and 80*b* are placed on a scale 90 to measure the front axle weight, $W_{front\ axle}$, of the car 50. Then, the actual distance, D1, between the center of gravity 86 and the rear axles 82*c* and 82*d* is determined based on the following formula:

$$D1 = D2 \times W_{front\ axle}/W_{car}.$$

After determining the actual distance, D1, between the center of gravity 86 and the rear axles 82*c* and 82*d*, the center of gravity 86 is preferably adjusted so that D1 equals the distance between the desired center of gravity and rear axles 82*c* and 82*d*, which was previously determined. If the distance D1 is greater than the desired distance between the center of gravity and rear axles, adjustable weights on the chassis 52 are moved toward the rear of the car to move the center of gravity 86 rearward. If the distance D1 is less than the desired distance between the center of gravity and rear axles, adjustable weights on the chassis 52 are moved toward the front of the car to move the center of gravity forward. After the center of gravity is adjusted, the distance D1 is recalculated according to the equation presented above. The steps of adjusting the center of gravity and recalculating the distance D1 are repeated until the distance D1 is approximately equal to the desired distance between the center of gravity 86 and the rear axles 82*c* and 82*d*.

Preferably, the method set forth above for adjusting the center of gravity of race car 50 encompasses using adjustable weight 10 to adjust the position of the center of gravity 86. As described above, adjustable weight 10 may be positioned within any of bores 72, 74, and 76 and moved forward and rearward within the bore by rotating cylinder 12. After the actual distance D1 is calculated as described above, adjustable weight 10 is preferably moved forward or rearward to adjust the center of gravity 86 until the distance D1 is approximately equal to the desired distance between the center of gravity 86 and the rear axles 82*c* and 82*d*.

Further, as shown in FIGS. 7 and 8, multiple adjustable weights 10, 100, 104, and 106 may be used to adjust the center of gravity 86 of model race car 50. According to this method for adjusting the center of gravity of the model race car, the interlocked weights 10 and 100 may be moved forward and rearward independent of the interlocked weights 104 and 106 for adjusting the center of gravity. Preferably, before the center of gravity is adjusted, a static weight 110 is positioned within the center bore 74 and affixed to the chassis 52 so that it is adjacent the rear wall 64 of the chassis. Additionally, if it is desirable to add more weight to the model race car, then incremental weights such as weight 108 may be interlocked with any of weights 10, 100, 104, and 106. Any weights that will ultimately be used with the model race car 50 must also be included in the car's total weight for purposes of calculating the distance D1 according to the equation above. Because competitions involving model race cars are typically governed by rules limiting the weight of the cars to a maximum allowable weight, it is often necessary to use a variety of different sized adjustable weights to ensure that the car's weight is as close as possible to the maximum allowable weight.

Although in the method described above for using multiple adjustable weights 10, 100, 104, and 106 to adjust the center of gravity of model race car 50 the moveable weights 10, 100, 104, and 106 are positioned in outside bores 72 and 76 and the static weight 110 is affixed in the center bore 74, it is within the scope of the invention for adjustable weights to be used in any or all of the bores, static weights to be used in any or all of the bores, or for a combination of adjustable weights and static weights to be used in any or all of the bores. For example, adjustable weights 10 and 100 may be positioned in center bore 74, while static weights such as weight 110 are positioned in the outer bores 72 and 76. Further, while the car 50 is shown as having three bores, the car may have more or less than three bores, and each of those bores may contain one or more adjustable weights, such as weight 10, or static weights, such as weight 110.

Further, while the stand 88 is shown as a block having a rectangular cross section, the stand may have any shape or size. Preferably, the stand used in the method is lightweight plastic that is molded to form a lower surface for being supported by a table and an upper surface having at least two recesses within which the rear wheels 82*c* and 82*d* of the car are positioned. The recesses help maintain the car's wheels on the stand while the weight of the car is being adjusted. Wheel blocks may also be placed in front of and/or behind the rear wheels for preventing the car from falling off the stand as the center of gravity is adjusted.

The present invention also encompasses a method for adjusting the front axle weight of a model race car, such as the race car 50 shown in FIGS. 6-9. According to this method, the desired front axle weight of the model race car is first determined by performing the following steps. First, a desired distance, D1, between the center of gravity 86 of the car 50 and the rear axles 82*c* and 82*d* of the car is selected. As discussed above, typically this value is approximately between 0.5 to 1 inches. The value can also be selected by trial and error due to the fact that each race car will have its own optimal distance between the center of gravity and rear axles to maximize the car's speed. After this distance is selected, the race car is weighed and that weight, $W_{car}$, is recorded. Then, the distance D2 between the front axles 82*a* and 82*b* and the rear axles 82*c* and 82*d* is measured and recorded. The desired front axle weight, $W_{front\ axle}$, of the car for the selected desired distance between the center of gravity 86 and the rear axles 82*c* and 82*d* is calculated according to the following formula:

$$W_{frontaxle}=D1\times W_{car}/D2.$$

Once the desired front axle weight is known, the rear wheels 80*c* and 80*d* of the race car 50 are placed on stand 88 and the front wheels 80*a* and 80*b* are placed on scale 90 to measure the front axle weight of the car. If the front axle weight measured by scale 90 is less than the desired front axle weight for the car, then adjustable weights on the chassis 52 are moved forward to increase the amount of weight on the car's front axles 82*a* and 82*b* until the front axle weight measured by the scale is approximately equal to the desired front axle weight. If the front axle weight is more than the desired front axle weight, then the adjustable weights are moved rearward to decrease the amount of weight on the front axles 82*a* and 82*b*.

Adjustable weight 10 can be used in the method for adjusting the front axle weight of the race car described above in the same manner that the adjustable weight 10 can be used in the method for adjusting the car's center of gravity described above. The weight 10 is rotated to move it forward or back within one of the car's bores in order to shift more or less of the car's weight onto or away from the front axles 82*a* and 82*b*. Further, any number of interlocked adjustable weights and static weights may be used with the front axle weight adjustment method in the same manner described above with respect to the center of gravity adjustment method.

The present invention also encompasses a method for adjusting the rear axle weight of a model race car, which is similar to the above described method for adjusting the front axle weight of a race car. According to the method for adjusting the rear axle weight, first a desired rear axle weight is selected. The rear axle weight, $W_{rear\ axle}$, may be selected for a desired distance between the rear axles and center of gravity, D1, according to the following equation:

$$W_{rearaxle} = W_{car}\times\left(1-\frac{D1}{D2}\right).$$

Once the desired rear axle weight is selected, the front wheels 80*a* and 80*b* of the race car 50 are placed on stand 88 and the rear wheels 80*c* and 80*d* are placed on scale 90 to measure the rear axle weight of the car. If the rear axle weight measured by scale 90 is less than the desired rear axle weight for the car, then adjustable weights on the chassis 52 are moved rearward to increase the amount of weight on the car's rear axles 82*c* and 82*d* until the rear axle weight measured by the scale is approximately equal to the desired rear axle weight. If the rear axle weight is more than the desired rear axle weight, then the adjustable weights are moved forward to decrease the amount of weight on the rear axles 82*a* and 82*b*. Any of the adjustable and static weights described above and the methods for positioning those weights within bores of the race car that are described above may also be used with this method for adjusting the rear axle weight of the race car 50.

For the methods of adjusting the front and rear axle weights of race car 50, tables may be used to determine the preferable front and rear axle weights in lieu of using the equations presented above. For determining the preferable front axle weight a series of tables may be used wherein each of the tables corresponds to a desired distance between the rear axles of the car and the center of gravity. Each table has a series of columns each of which corresponds with a different distance between the car's front and rear axles and a series of rows each of which corresponds with a different car weight. At the intersection of each row and each column is a value that is the preferable front axle weight for the combination of distance between the rear axles and center of gravity, distance between the front and rear axles, and total car weight. For determining the preferable rear axle weight a series of similar tables may be used which substitute the preferable front axle weights for the preferable rear axle weights, which equal the weight of the car minus the preferable front axle weights.

For any of the equations or calculations presented above, it is within the scope of the invention to substitute for the distance D1 between the center of gravity and rear axles, the distance between the front and rear axles minus the distance between the center of gravity and front axles, as it is widely known that these values are equal. Further, it is within the scope of the invention to substitute for the front axle weight, $W_{front\ axle}$, the value of the weight of the car, $W_{car}$, minus the rear axle weight, $W_{rear\ axle}$, as it is widely known that these values are also equal.

It is also within the scope of the present invention to provide a kit having multiple adjustable weights and static weights so that a user of the kit has a variety of different sized weights to adjust the center of gravity and axle weights of a model race car. According to one embodiment of kit according to the present invention, the kit may include some or all of the following components: an adjustable weight 10, a static weight 110, a static weight 108, a chassis 52, wheels 80*a-d*, axles 82*a-d*, a series of tables such as described above to determine preferable front and rear axle weights, a hex key wrench or other tool for moving the adjustable weight 10 within a bore of the chassis 52, a stand 88, a scale 90, and/or a drill bit for forming bores within the chassis.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. An adjustable weight system for use with an object having a bore surrounded by a bore surface, comprising:

a cylinder configured to be positioned within said bore, said cylinder comprising a side wall, opposing end walls each joined with said side wall, screw threads integral with said side wall and configured to form complemental threads in said bore surface, and a protrusion joined with and extending from one of said end walls, wherein the other of said end walls presents an opening for engaging a tool for adjustably positioning said cylinder within said bore and forming said complemental threads, and wherein said protrusion and said opening have complementary shapes.

2. The system of claim 1, wherein said opening is configured to receive an end of a tool for rotating said cylinder within said bore.

3. The system of claim 1, wherein said cylinder comprises a first cylinder, said system further comprising:

a second cylinder configured to be positioned within said bore, said second cylinder comprising a side wall, opposing end walls each joined with said side wall, and screw threads integral with said side wall and configured to form complemental threads in said bore surface, wherein one of said end walls of said second cylinder presents an opening configured to receive said protrusion extending from said first cylinder such that when said opening receives said protrusion said threads on said first and second cylinders are aligned.

4. The system of claim 3, wherein said protrusion of said first cylinder further comprises at least one surface comprising a spline and said opening in said end wall of said second cylinder is defined by at least one surface comprising a groove that is configured to receive said spline for aligning said threads on said first and second cylinders.

5. The system of claim 4, wherein said opening in said end wall of said second cylinder is configured to receive an end of a tool for rotating said cylinder within said bore.

6. The system of claim 1, wherein said cylinder comprises a first cylinder, said system further comprising:

a second cylinder configured to be positioned within said bore, said second cylinder comprising a side wall and opposing end walls each joined with said side wall, wherein one of said end walls of said second cylinder presents an opening configured to receive said protrusion extending from said first cylinder.

7. The system of claim 1, wherein said object comprises a wooden model race car and said bore is accessible via an opening in a surface of the race car.

8. The system of claim 1, wherein said bore has a diameter that is no greater than a major diameter of said screw threads.

9. A method for adjusting the weight of a model race car, wherein the car has an outer surface presenting an opening for accessing a bore within the object, and wherein the bore extends from a rear of the car toward a front of the car, comprising:

providing a cylinder comprising a side wall, opposing end walls each joined with said side wall, and screw threads integral with said side wall, wherein said cylinder is shorter than the bore in the car;

positioning at least a portion of said cylinder within said bore so that said threads engage an inner surface surrounding said bore; and rotating said cylinder to move said cylinder to a desired position within said bore while said threads form complemental threads in said inner surface which retain said cylinder within said bore, wherein said cylinder is adjustably moveable within said bore from the rear of the car toward the front of the car for adjusting the center of gravity of the car.

10. The method of claim 9, wherein said cylinder comprises a first cylinder, said first cylinder further comprising a protrusion joined with and extending from one of said end walls, said method further comprising:

providing a second cylinder comprising a side wall, opposing end walls each joined with said side wall, and screw threads integral with said side wall, wherein one of said end walls of said second cylinder presents an opening configured to receive said protrusion extending from said first cylinder such that when said opening receives said protrusion said threads on said first and second cylinders are aligned;

placing said protrusion on said first cylinder within said opening in said second cylinder;

positioning at least a portion of said first and second cylinders within said bore so that said threads on said cylinders engage said inner surface surrounding said bore; and rotating said first and second cylinders to move said cylinders to a desired position within said bore.

11. The method of claim 9, wherein said race car comprises a chassis, at least one front wheel mounted to said chassis with a front axle, and at least one rear wheel mounted to said chassis with a rear axle, said method further comprising:

selecting a desired front axle weight for the race car;

placing the rear wheel of the race car on a stand;

placing the front wheel of the race car on a scale to measure the front axle weight of the car; and rotating said cylinder to move said cylinder within said bore until the front axle weight measured by the scale approximately equals the desired front axle weight.

12. The method of claim 11, wherein said step of selecting a desired front axle weight comprises:

selecting a first distance between the center of gravity of the model race car and the rear axle of the model race car;

weighing the model race car;

measuring a second distance between the front axle and the rear axle;

calculating a first value by multiplying the first distance by the weight of the car; and calculating the desired front axle weight by dividing the first value by the second distance.

13. The method of claim 11, wherein said bore comprises a first bore in the chassis of the model race car, said chassis presents a second bore, the first and second bores each accessible through separate openings in a rear surface of the car, wherein said cylinder comprises a first cylinder positioned in said first bore, and wherein said method further comprises:

providing a second cylinder comprising a side wall, opposing end walls each joined with said side wall, and screw threads integral with said side wall;

positioning at least a portion of said second cylinder within said second bore so that said threads on said second cylinder engage an inner surface surrounding said second bore; and rotating said second cylinder to move said second cylinder within said second bore until the front axle weight measured by the scale approximately equals the desired front axle weight.

14. The method of claim 13, wherein said chassis presents a third bore positioned between said first and second bores, said third bore being accessible through an opening in the rear surface of the car, wherein said method further comprises positioning a weight within the third bore such that the weight is generally adjacent to the rear surface of the car.

15. A method for adjusting the center of gravity of a model race car, said race car comprising a chassis, at least one front wheel mounted to said chassis with a front axle, at least one rear wheel mounted to said chassis with a rear axle, and at least one adjustable weight that is moveable with respect to the chassis, comprising:

selecting a desired center of gravity location for the model race car;

determining a first distance between the desired center of gravity location and the rear axle;

weighing the model race car;

measuring a second distance between the front axle and the rear axle;

placing the rear wheel of the race car on a stand;

placing the front wheel of the race car on a scale to measure the front axle weight of the car;

calculating a first value by multiplying the second distance by the front axle weight;

calculating the distance between a center of gravity for the car and the rear axle by dividing the first value by the weight of the car; and moving the adjustable weight until the distance between the center of gravity and the rear axle is approximately equal to the first distance.

16. The method of claim 15, wherein said adjustable weight is a cylinder that is positioned within a bore of said race car, said cylinder comprising screw threads that engage an inner surface surrounding said bore, said step of moving the adjustable weight comprises rotating said cylinder to move said cylinder to a desired position within said bore while said threads form complemental threads in said inner surface which retain said cylinder within said bore.

17. A method for adjusting the front axle weight of a model race car, said race car comprising a chassis, at least one front wheel mounted to said chassis with a front axle, at least one rear wheel mounted to said chassis with a rear axle, and at least one adjustable weight that is moveable with respect to the chassis, comprising:

selecting a desired front axle weight for the race car;

placing the rear wheel of the race car on a stand;

placing the front wheel of the race car on a scale to measure the front axle weight of the car; and moving the adjustable weight until the front axle weight measured by the scale approximately equals the desired front axle weight.

18. The method of claim 17, wherein said adjustable weight is a cylinder that is positioned within a bore of said race car, said cylinder comprising screw threads that engage an inner surface surrounding said bore, said step of moving the adjustable weight comprises rotating said cylinder to move said cylinder to a desired position within said bore while said threads form complemental threads in said inner surface which retain said cylinder within said bore.

19. A method for adjusting the rear axle weight of a model race car, said race car comprising a chassis, at least one front wheel mounted to said chassis with a front axle, at least one rear wheel mounted to said chassis with a rear axle, and at least one adjustable weight that is moveable with respect to the chassis, comprising:

selecting a desired rear axle weight for the race car;

placing the front wheel of the race car on a stand;

placing the rear wheel of the race car on a scale to measure the rear axle weight of the car; and moving the adjustable weight until the rear axle weight measured by the scale approximately equals the desired rear axle weight.

20. The method of claim 19, wherein said adjustable weight is a cylinder that is positioned within a bore of said race car, said cylinder comprising screw threads that engage an inner surface surrounding said bore, said step of moving the adjustable weight comprises rotating said cylinder to move said cylinder to a desired position within said bore while said threads form complemental threads in said inner surface which retain said cylinder within said bore.

21. An adjustable weight system for use with an object having a bore surrounded by a bore surface, comprising:

first and second cylinders configured to be positioned within said bore, each of said cylinders comprising a side wall and opposing end walls each joined with said side wall, wherein one of said cylinders comprises screw threads integral with said side wall and configured to form complemental threads in said bore surface, wherein one of said cylinders comprises structure associated with one of said end walls for engaging a tool for adjustably positioning said cylinders within said bore and forming said complemental threads, and wherein one of said cylinders comprises a protrusion joined with and extending from one of said end walls, and one of said end walls of the other of said cylinders presents an opening configured to receive said protrusion extending from said other cylinder.

22. The system of claim 21, wherein both of said cylinders comprise screw threads integral with said side wall and configured to form complemental threads in said bore surface, and wherein when said opening receives said protrusion said threads on said first and second cylinders are aligned.

23. A method for adjusting the weight of an object, wherein the object has an outer surface presenting an opening for accessing a bore within the object, comprising:

providing first and second cylinders each comprising a side wall, opposing end walls each joined with said side wall, and screw threads integral with said side wall, wherein one of said cylinders comprises a protrusion joined with and extending from one of said end walls, and one of said end walls of the other of said cylinders presents an opening configured to receive said protrusion extending from said other cylinder such that when said opening receives said protrusion said threads on said first and second cylinders are aligned;

placing said protrusion on one of said cylinders within said opening in the other of said cylinders;

positioning at least a portion of said cylinders within said bore so that said threads on said cylinders engage an inner surface surrounding said bore; and rotating said cylinders to move said cylinders to a desired position within said bore while said threads form complemental threads in said inner surface which retain said cylinders within said bore.

* * * * *